US007896165B2

(12) United States Patent
Hakola

(10) Patent No.: US 7,896,165 B2
(45) Date of Patent: Mar. 1, 2011

(54) CYCLONE HAVING A VIBRATION MECHANISM

(76) Inventor: Gordon R. Hakola, Paradise Valley, AZ (US)

( * ) Notice: Subject to any disclaimer, the term of this patent is extended or adjusted under 35 U.S.C. 154(b) by 457 days.

(21) Appl. No.: 12/001,949

(22) Filed: Dec. 14, 2007

(65) Prior Publication Data

US 2008/0093266 A1 Apr. 24, 2008

Related U.S. Application Data

(63) Continuation-in-part of application No. 11/291,281, filed on Dec. 2, 2005, now Pat. No. 7,347,332.

(51) Int. Cl.
*B04C 5/00* (2006.01)

(52) U.S. Cl. ..... 209/715; 209/159; 55/435; 55/459.1

(58) Field of Classification Search ..... 209/711, 209/712, 715, 717, 721, 728, 729, 719; 55/435, 55/459.1

See application file for complete search history.

(56) References Cited

U.S. PATENT DOCUMENTS 3,178,068 A * 4/1965 Dumbaugh ..... 222/161
4,149,861 A * 4/1979 Sogo et al. ..... 96/372
6,355,178 B1 * 3/2002 Couture et al. ..... 210/748.05
7,185,765 B2 * 3/2007 Hakola ..... 209/734
7,347,332 B2 * 3/2008 Hakola ..... 209/715
7,357,824 B2 * 4/2008 Hakola ..... 55/435
7,404,491 B2 * 7/2008 Hakola ..... 209/715

FOREIGN PATENT DOCUMENTS

JP 05068861 A * 3/1993

* cited by examiner

*Primary Examiner* — Patrick Mackey
*Assistant Examiner* — Jeremy Severson
(74) *Attorney, Agent, or Firm* — Herbert E. Haynes, Jr.

(57) ABSTRACT

A materials classifying cyclone with at least one vibrator for transmitting generated vibrations into the downwardly swirling slurry of materials to interrupt the flow pattern thereof so that some of the smaller particles trapped in the outer portions of the slurry are freed for movement into the vortex of the cyclone to increase the operating efficiency of the cyclone. In a first embodiment, the cyclone has a solid metallic conical housing with the vibrator attached to the periphery of the housing. In a second embodiment, a plurality of longitudinal struts in spaced apart relationship provide the conical housing with open sides with the vibrator mounted on one of the struts which transmit the vibrations to abrasion resistant liners mounted in the housing. In still another embodiment, the vibrator is coupled to an abrasion resistant liner which is exposed in one of the open spaces of the conical housing.

16 Claims, 5 Drawing Sheets

CYCLONE HAVING A VIBRATION MECHANISM

CROSS REFERENCE TO A RELATED APPLICATION

This application is a continuation-in-part of co-pending application entitled Cyclone Having a Vibrating Mechanism, Ser. No. 11/291,281 filed Dec. 2, 2005 now U.S. Pat. No. 7,347,332 by the same applicant.

BACKGROUND OF THE INVENTION

1. Field of the Invention

This invention relates in general to cyclones and more particularly to cyclones having a vibration system for improving the separation of fine particles from a swirling slurry of materials being classified in the cyclone.

2. Description of the Prior Art

Cyclones are mechanisms used in various industries to separate different sized particles of materials that are fed as a slurry into the inlet of the cyclone. In the mineral processing industries such as for example in the processing of copper, iron ore, lead/zinc, gold, coal and the like, a plurality of large cyclones are typically carried in mounting bases arranged in a cluster over a "tub". Each of the cyclones are in circuit with grinding mills and a slurry formed of a liquid, often times water, and the mineral to be classified is fed into the inlet of the cyclone. The larger, and therefore heavier materials in the slurry exit through an underflow outlet at the bottom of the cyclone and are returned to the grinding mill for reprocessing and are subsequently returned to the cyclone. The smaller, and therefore lighter materials are carried upwardly in a vortex created within the cyclone and exit through an overflow outlet nozzle at its upper end.

The primary components of a cyclone include an inlet housing having a feed duct, a cylindrical head section, a head section cover plate with a vortex finder located centrally in the cover plate. A downwardly tapering conical housing depends from the head section and an apex cone is located at the lower end of the conical housing with the heavy material underflow outlet being connected to the lower end of the apex cone. The overflow outlet nozzle is coupled to the vortex finder and suitable ducts are provided to carry away the slurry containing the lighter materials. In some cyclones, the internal surfaces of the various components thereof are provided with replaceable liners which help prevent the cyclone components from being destroyed by the highly abrasive nature of the materials being classified therein.

The feed duct of a cyclone, which is often referred to as an involute, receives the slurry at high velocity from the grinding mill and directs it tangentially into the cylindrical inlet head section of the cyclone. As the slurry swirls around in the head section, centrifugal force will keep the slurry adjacent the sidewalls of the cyclone as it moves downwardly under the influence of gravity into the conical housing of the cyclone. Also, centrifugal force will cause the larger particles of the materials being classified to migrate to the outside of the slurry at a relatively rapid rate and the finer particles will migrate at a comparatively slower rate. Therefore, a portion of the finer particles will be carried in the inner portions of the slurry and some will migrate to the outer portion thereof. The larger particles the will move downwardly and will exit the cyclone through the underflow outlet. The lighter materials located in the inner portion of the slurry along with the liquid carrying them will enter the vortex created within the apex cone and will move upwardly through the center of the conical housing into the vortex finder and exit the cyclone through the overflow outlet.

There is not a clear demarcation between the larger and smaller particles of the materials within the swirling slurry and some of the lighter particles are located within the outer portion of the slurry along with the larger particles. An undesirable amount of the lighter particles that are located in the outer portion of the slurry become trapped therein and exit the cyclone along with the larger particles through the underflow outlet of the cyclone. This keeps the operating efficiency of cyclones below an ideal level, which effects the entire system including the grinding mill, the pumps that supply the slurry to the cyclones and the cyclones themselves. The resulting low efficiency of the system effects the time, energy usage, the costs for processing the materials, and of course the longer a system must operate to process a given quantity of material the greater the wear will be on the system components.

To the best of my knowledge, no prior art mechanism or method has been devised to help release the smaller particles which become trapped in the downwardly spiraling slurry within a cyclone. Therefore, a need exists for a new and useful mechanism and method for use in a materials classifying cyclone to reduce the quantity of small particles trapped in the outer portions of the slurry so that they can enter the vortex of the cyclone rather than exiting therefrom along with the larger particles.

SUMMARY OF THE INVENTION

The present invention discloses cyclones having at least one vibrating device attached thereto which is operated to generate vibrations in the downwardly tapering conical housings of the cyclones. The vibrations are transmitted into the downwardly spiraling slurry of materials being processed in the cyclones to release some of the smaller particles which would otherwise remain trapped within the slurry.

In a first embodiment, a cyclone of conventional configuration is modified by having at least one vibrating device welded or otherwise affixed to the metal housing of the downwardly tapering conical housing thereof. Vibrations generated by the vibrating device are transmitted through the side walls of the conical metal housing and the replaceable liners into the slurry. In this manner the normal flow patterns of the slurry are interrupted by bouncing both the larger and smaller particles of the materials being classified off of the interior surface of the liners so that at least some of the smaller particles which would otherwise be trapped in the slurry will be free to enter the vortex created within the cyclone.

In a second embodiment, at least one vibrating device is mounted on an especially configured cyclone of the type disclosed in my co-pending U.S. patent application Ser. No. 11/087,998, filed Mar. 24, 2005 for a Cyclone With In-situ Replicable liner Mechanism and Method For Accomplishing Same. This special cyclone includes, among other things, an open-sided downwardly tapering conical housing in place of the all metal housing of conventionally configured cyclones as discussed above in the first embodiment of the present invention. The open-sided conical housing includes a ring-shaped flange which circumscribes its open upper end and a sleeve at its lower apex end. The ring and sleeve are interconnected by a plurality of struts each of which is shown herein to be an assembly formed of a pair of angle beams arranged in a spaced apart relationship with liner support plates mounted there between. The replaceable liners used in this open-sided conical housing are of truncated conical configuration and are manufactured with a rigid metallic layer to which an abrasion resistant material such as urethane is affixed. In a first configuration, the replaceable liners are formed with the rigid metallic layer being an external element with the abrasion resistant material bonded to the interior surface thereof. In a second configuration, the replaceable liners are formed with the rigid metal layer being an internal element which is imbedded within the abrasion resistant material. The liner support plates mounted in the strut assemblies are in engagement with the replaceable liners. As mentioned above, at least one vibrating device is mounted on this especially configured cyclone to free some of the small particles trapped in the slurry so that they can enter the vortex created within the cyclone. In a first configuration, the vibrating device is mounted on one of the struts so that the vibrations generated by the device are transmitted through the struts and the liner support plates to the replaceable liners. In a second configuration, the replaceable liners are formed with at least one protruding rib to which the vibrating device is mounted.

DESCRIPTION OF THE PREFERRED EMBODIMENTS

Figure 1:
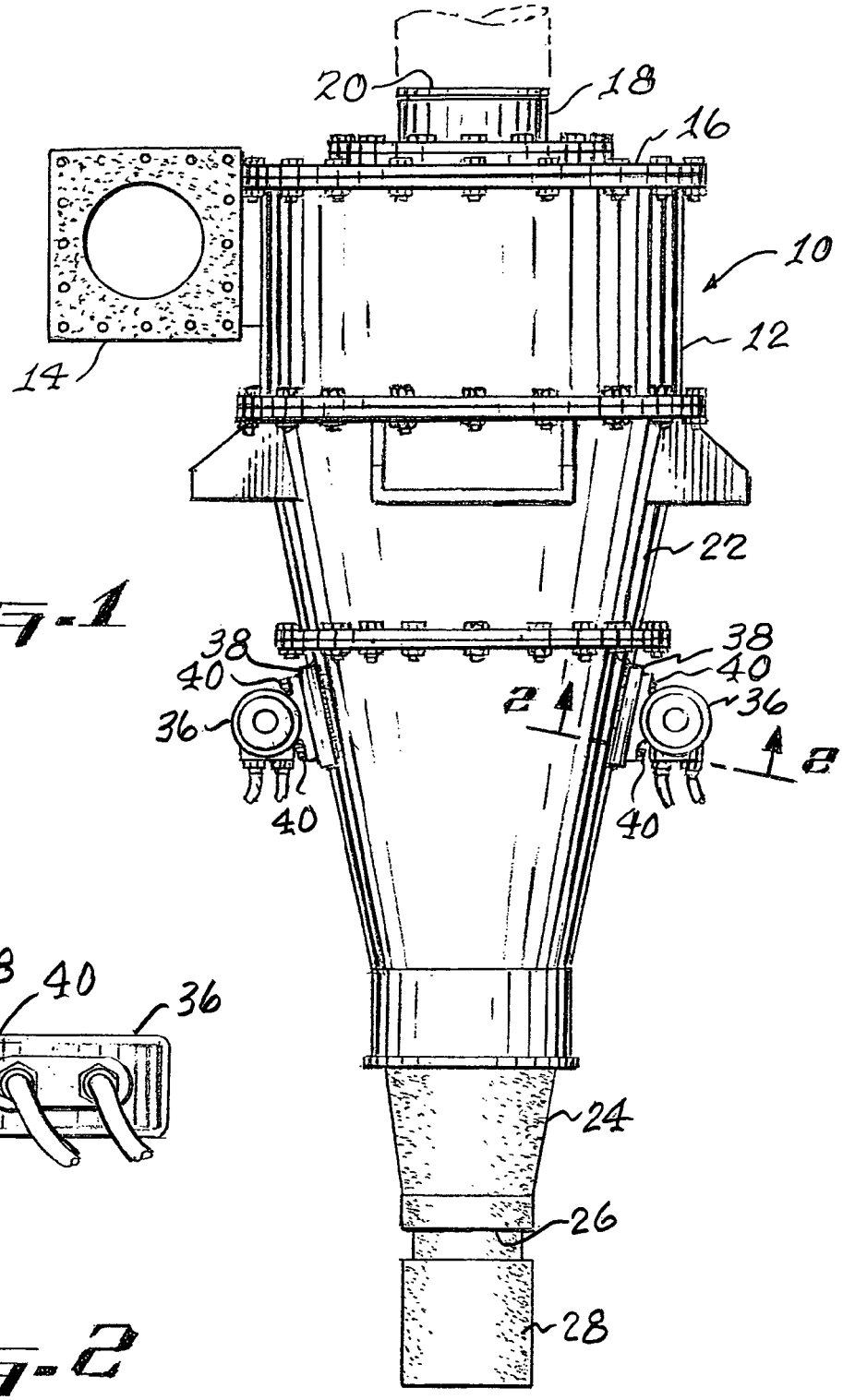
FIG. 1 is an elevational view of a conventional cyclone having vibrating mechanisms mounted on the sidewall of the conical housing of the cyclone in accordance with a first embodiment of the present invention.

Referring more particularly to the drawings, FIG. 1 shows a cyclone which is indicated generally by the reference numeral 10. The cyclone 10 is of conventional configuration which is in common use especially in the mineral processing industry. The major components of the cyclone 10 include a cylindrical head section 12 having an inlet duct 14 through which the material to be classified is directed tangentially into the head section at high velocity. The head section 12 has a cover plate 16 closing its open upper end with a nozzle 18 extending upwardly from the cover plate to form the overflow outlet 20 of the cyclone 10. The head section 12 is open at its lower end and a downwardly tapering conical housing 22 depends there from with an apex cone 24 extending through the open lower end of the conical housing to form the underflow outlet 26 of the cyclone 10. An optional anti-splash apron 28 can be mounted on the lower end of the apex cone 24. It will be appreciated that the materials that are classified within cyclones are oftentimes abrasive and to minimize the destructive forces of such an abrasive environment, they are provided with internally mounted abrasion resistant liners with a fragmentary portion of one of such liners 30 being shown in FIG. 2. Abrasion resistant liners of various types are used as determined by the type of materials being processed and by manufacturer's preferences. The liner 30 shown in FIG. 2 includes a metallic substrate 32 of conical configuration with the abrasion resistant material 34 bonded to the interior surface thereof. Another abrasion resistant liner configuration is disclosed as will hereinafter be described in detail.

To insure a clear understanding of the present invention, a brief description of a typical material classification installation (not shown) and the operation of the cyclone 10 will now be presented. A cyclone is a mechanism that is used in various industries to classify, that is separate, different sized particles of materials that are fed as a slurry into the inlet of the cyclone. In the mineral processing industries such as for example in the processing of copper, iron ore, lead/zinc, gold, coal and the like, a plurality of large cyclones are typically carried in mounting bases arranged in a cluster over a "tub". Each of the cyclones are in circuit with grinding mills (not shown) and a slurry formed of a liquid, usually water, and the material to be classified is supplied to the cyclones. The inlet, or feed duct 14 of the cyclone 10, which is often referred to as an involute, receives the slurry at a high velocity and directs it tangentially into the cylindrical inlet head section 12 of the cyclone. As the slurry swirls around in the head section, centrifugal force will keep the slurry adjacent the sidewalls of the cyclone as it moves downwardly under the influence of gravity into the conical housing 22 of the cyclone. Also, centrifugal force will cause the larger and therefore heavier particles of the materials being classified to migrate to the outside of the slurry at a relatively rapid rate and the smaller and therefore lighter particles will migrate at a comparatively slower rate. Therefore, some of the smaller particles will remain in the inner portions of the slurry and some will migrate into the outer portion thereof. The particles located in the outer portion of the slurry will move downwardly through the apex cone 24 and will be discharged through the underflow outlet 26 of the cyclone 10. The portion of the smaller materials located in the inner portion of the slurry along with the liquid carrying them will enter a vortex that is created within the apex cone 24 and will move upwardly through the center of the conical housing 22, through the cylindrical head section 12 and will exit the cyclone 10 through the overflow outlet 20.

As indicated above, there is not a clear demarcation between the larger and smaller particles of the materials within the swirling slurry and some of the smaller particles will be located within the outer portion of the slurry along with the larger particles. An undesirable amount of the smaller particles that are located in the outer portion of the slurry become trapped therein and exit the cyclone 10 along with the larger particles through the underflow outlet 26 of the cyclone and this keeps the operating efficiency of cyclone below an ideal level.

Figure 2:
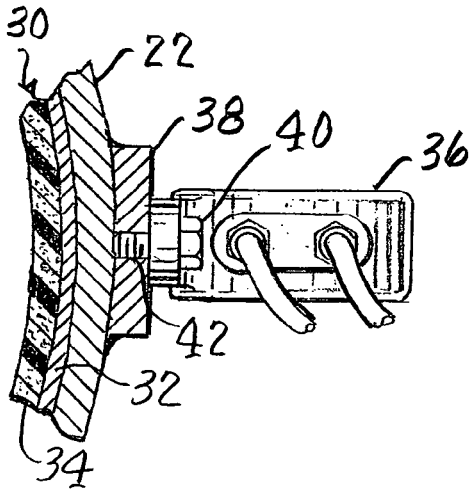
FIG. 2 is an enlarged fragmentary sectional view taken along the line 2-2 of FIG. 1.

In accordance with a first embodiment of the present invention, the cyclone 10 includes at least one vibrating device 36 which is affixed to the outer surface of the conical housing 22 as seen in FIGS. 1 and 2. The vibrator 36, which may be affixed in any suitable manner, is shown as being attached to a nut plate 38 by bolts 40 which are mounted in threaded bores 42 (one shown) formed in the plate 38. The nut plate 38 is affixed to the conical housing 22 such as by welding. The vibrating device 36 is operated to generate vibrations in the metallic body of the conical housing 22 of the cyclone 10 and those vibrations are transmitted through the abrasion resistant liners 30 located in the housing 22 and into the downwardly spiraling slurry being processed in the cyclone 10. In this manner the normal flow patterns of the slurry are interrupted by bouncing both the larger and smaller particles of the materials being classified off of the interior surface of the liners 30 so that at least some of the smaller particles which would otherwise be trapped in the slurry will be freed to enter the vortex created within the cyclone 10.

Figure 3:
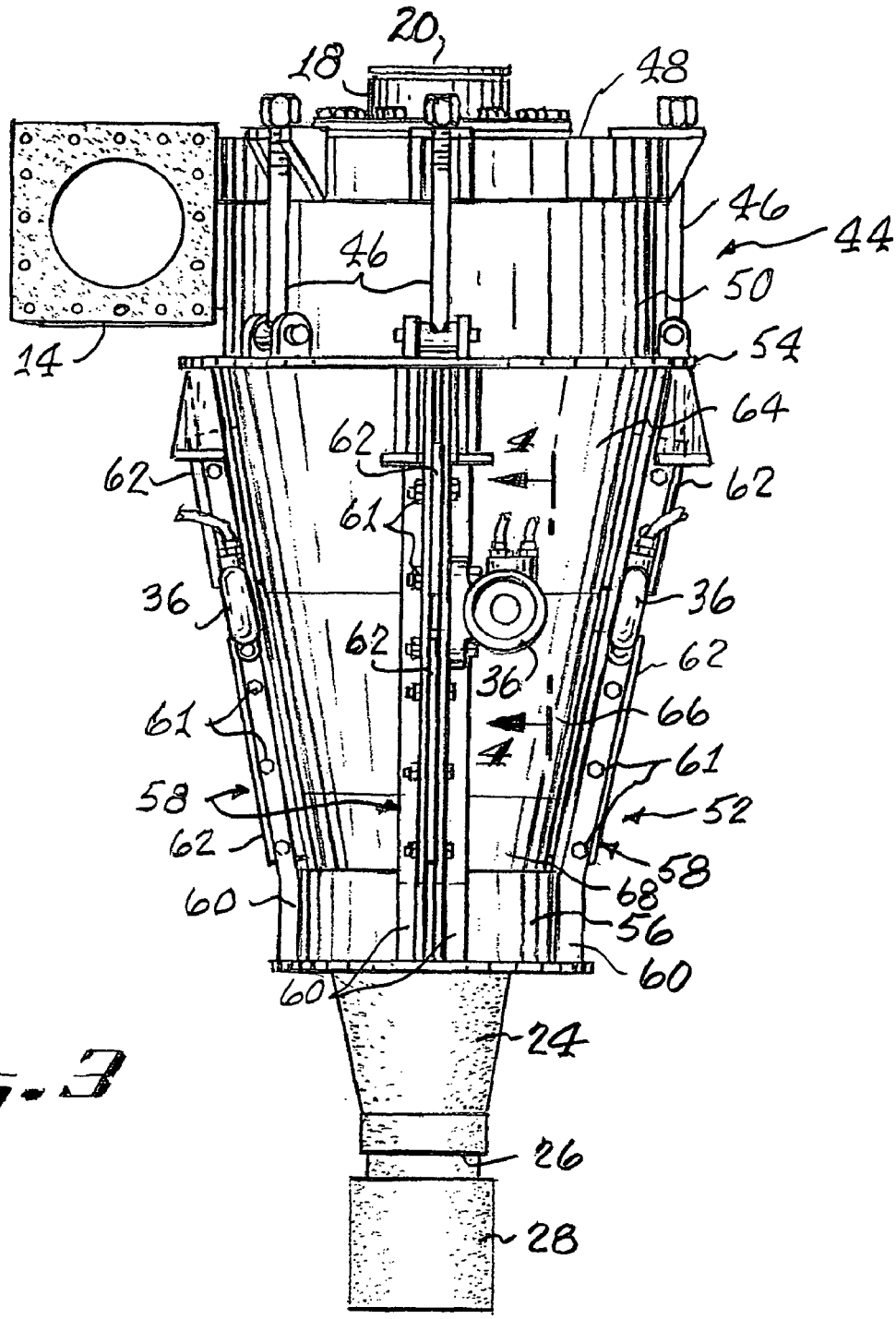
FIG. 3 is fragmentary elevational view of an especially configured open-sided cyclone in which the vibrating mechanisms are mounted thereon in accordance with a second embodiment of the present invention.

FIG. 3 shows a second embodiment as including a special cyclone 44 of the type disclosed in my previously mentioned co-pending U.S. patent application. This special cyclone 44 includes plurality of swing bolts 46, or other suitable means such as removable tension rods (not shown), which mount the cover plate 48 on the top of the head section 50 and also mount a special open-sided downwardly tapering conical housing 52 below the head section 50. The open-sided conical housing 52 includes a flange 54 which circumscribes its open upper end and a sleeve 56 at its lower apex end. The ring-shaped flange 54 and the sleeve 56 are interconnected by a plurality of strut means 58 which may be of any suitable configuration such as I-beams, circular in cross-section beams, or the like. Each of the struts are shown herein as an assembly formed of a pair of angle beams 60 connected to each other in a parallel spaced apart relationship by suitable bolts 61 with liner support plates 62 mounted there between. In that the sides of the conical housing 52 are open, the liners provided therein are seen to include an upper abrasion resistant liner 64, a middle abrasion resistant liner 66 and a lower abrasion resistant liner 68 with all three being of truncated conical configuration. As described above in the description of the abrasion resistant liners 30 of the first embodiment, the abrasion resistant liners 64, 66 and 68 are similar, in that they are formed with metal substrates 70 having a suitable abrasion resistant material 72 bonded to the inner surface thereof as shown in the fragmentary sectional view of the liners 64 and 66 in FIG. 4.

Figure 4:
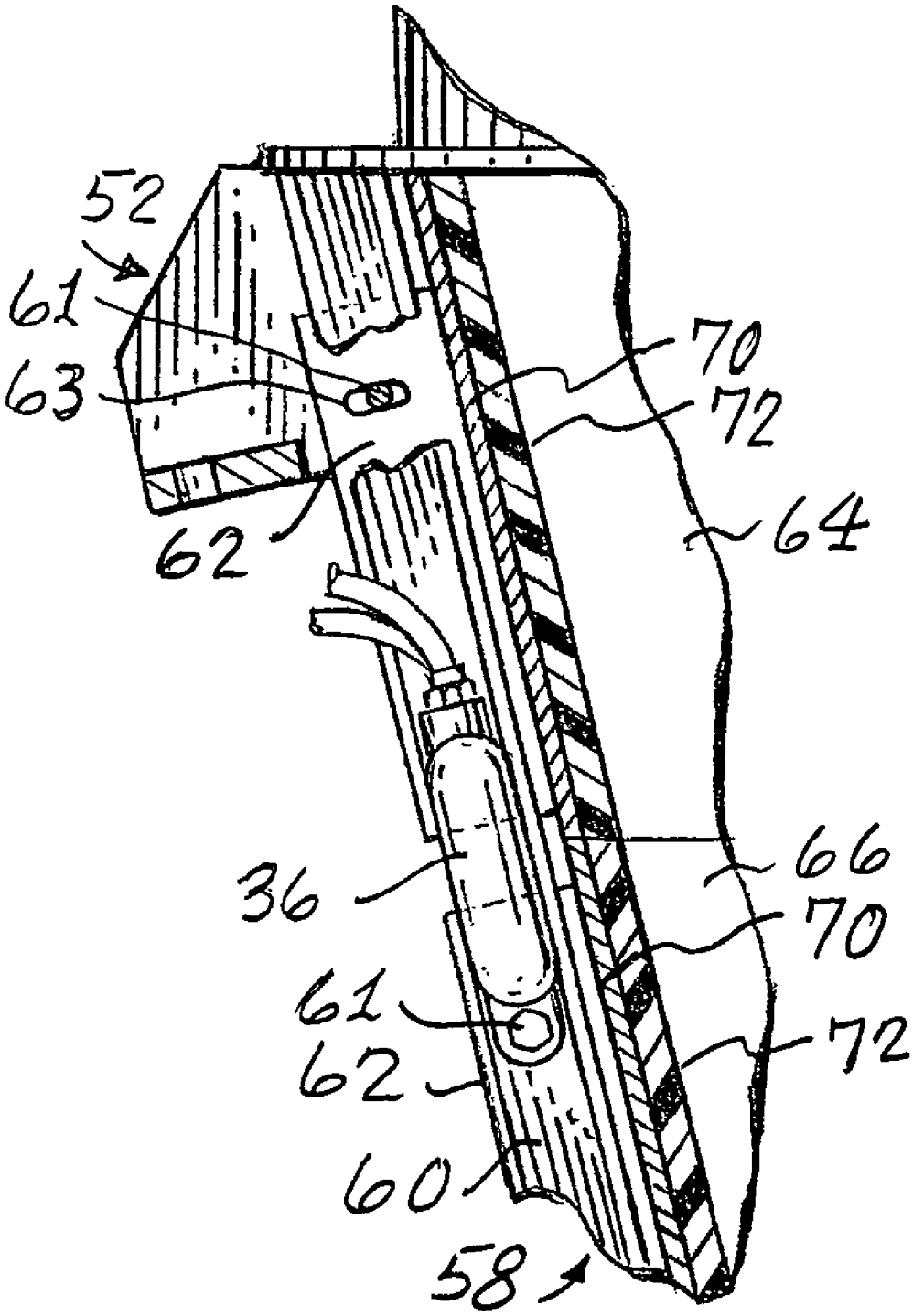
FIG. 4 is an enlarged fragmentary sectional view taken along the line 4-4 of FIG. 3.

The liner support plates 62 mounted in the strut assemblies 58 are shown in FIG. 4 as having slotted holes 63 (one shown) through which the mounting bolts 61 pass to mount the plates in the strut assemblies. In this manner, the liner support plates 62 extend into engagement with the liners 64, 66 and 68 and are adjustable for centering and aligning the liners and provide contiguous engagement of the plates with the metal substrates 70 of the abrasion resistant liners. At least one vibrating device 36 is mounted by a pair of the bolts 61 on one of the strut assemblies 58. The vibrations generated by the vibrating device 36 are transmitted through the angle beams 60 of the strut assembly 58 on which it is mounted and the liner support plates 62 to the abrasion resistant liners 64, 66 and 68 to free some of the small particles trapped in the slurry, in the manner hereinbefore described.

Figure 5:
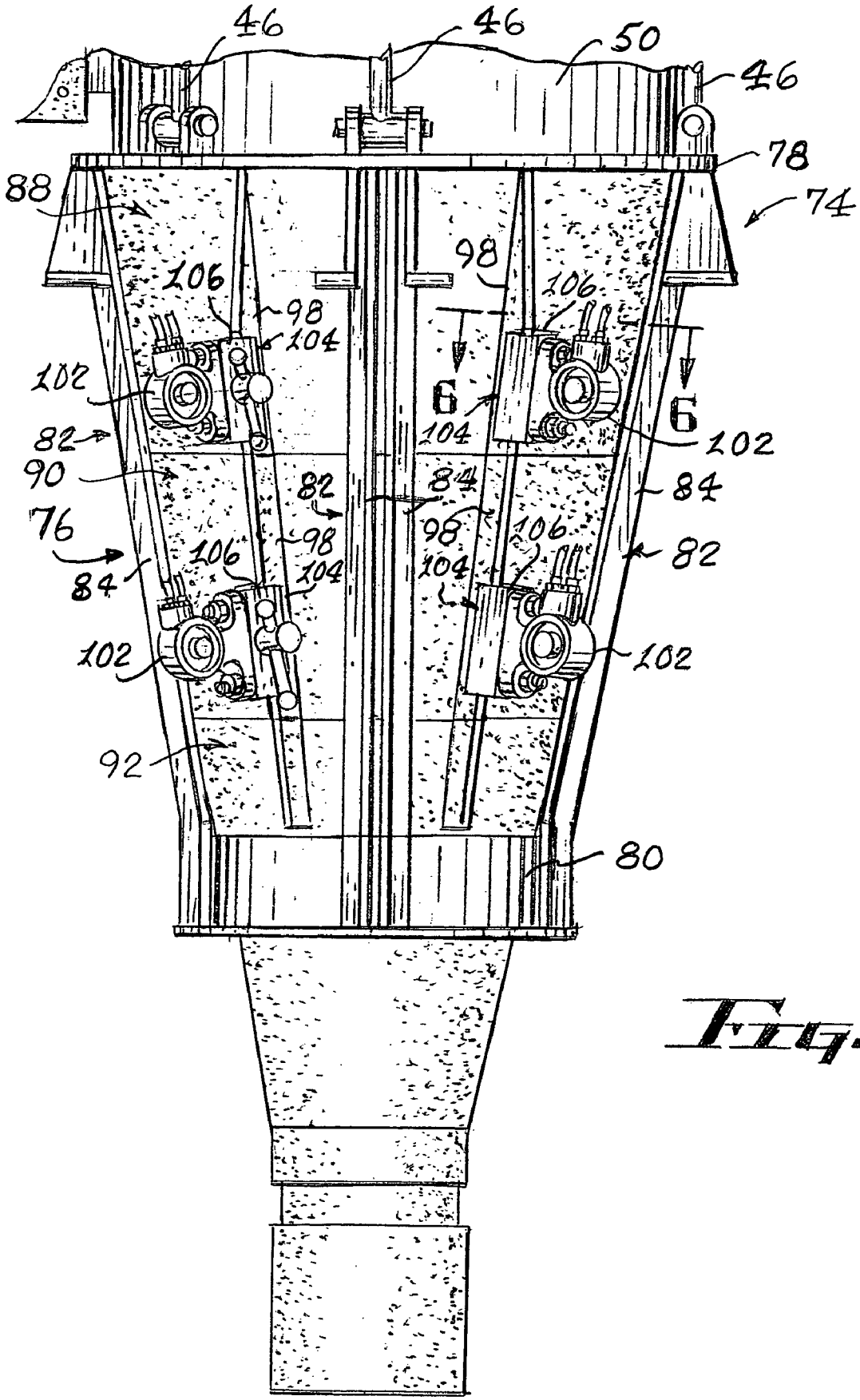
FIG. 5 is an enlarged fragmentary view of a cyclone similar to that shown in FIG. 3 and showing the vibrating mechanisms as being mounted thereon in accordance with a third embodiment of the present invention.

FIG. 5 shows a third embodiment of the present invention as including a special cyclone 74 which is a modified version of the previously described cyclone 44. The cyclone 74 has the same swing bolts 46 and head section 50, and a modified open-sided conical housing 76. The conical housing 76 includes the ring-shaped flange 78 that circumscribes the open upper end of the housing and the sleeve 80 located at the lower end of the housing. The flange and sleeve are interconnected by the strut means 82 which are similar to the previously described strut means 58 in that they include a spaced apart pair of angle beams 84. However, the angle beams 84 are not connected to each other and the liner support plates 62 mounted between the angle beams 60 of the prior strut means 58 are omitted.

Figure 6:
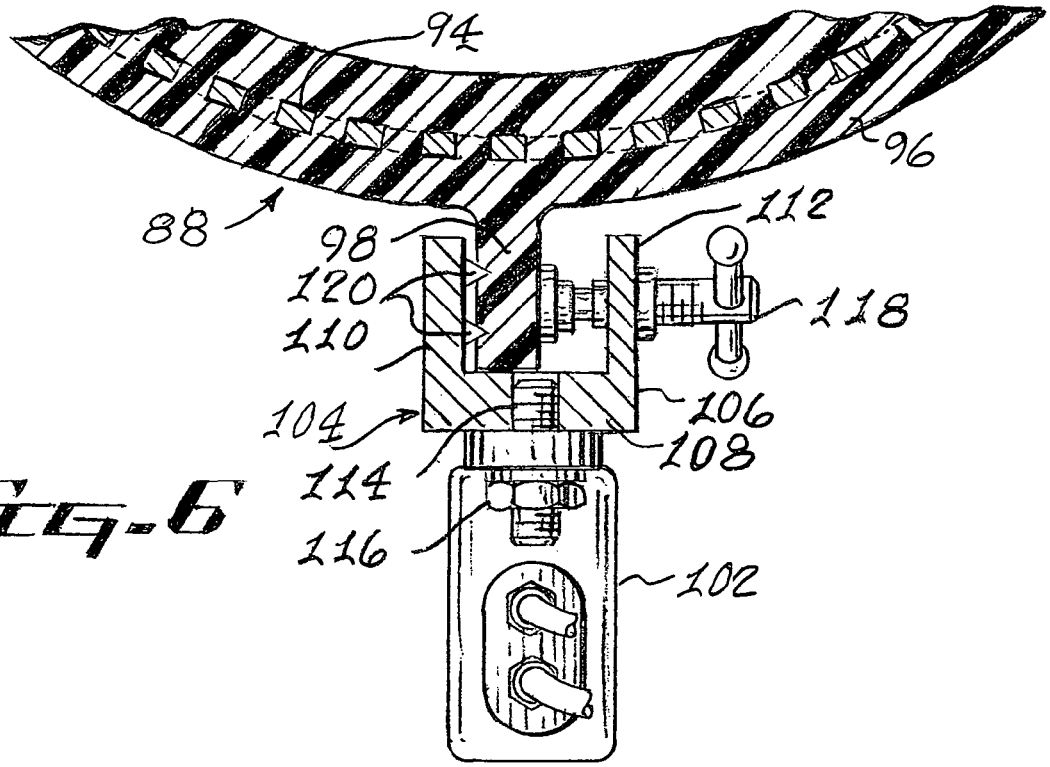
FIG. 6 is an enlarged fragmentary sectional view taken along the line 6-6 of FIG. 5. and showing a first attachment means for mounting of the vibrating mechanism.

Especially configured upper, middle and lower abrasion resistant liners 88, 90 and 92 respectively, are of different sizes with the upper liner being the largest and the middle and lower liners decreasing in size so that they can be mounted in the open-sided conical housing 76. Although the liners are of different sizes, they are of similar configuration, and the following description of the liner 88 as seen in FIG. 6 will be understood to apply to the other liners 90 and 92.

The liner 88 includes a perforated rigid structure 94 which is embedded within abrasion resistant material 96. The rigid structure 94 may be made of any suitable material such as metal, which is formed into the desired truncated conical configuration and the abrasion resistant material 96, which may be urethane, rubber, ceramic or the like, is cast around the rigid structure. The casting of the abrasion resistant material 96 includes the integral formation of laterally protruding ribs 98 which are formed of the liner material and extend longitudinally of the liner 88. The typical liner 88, discussed above is a first embodiment and FIG. 7 shows a second embodiment which is identified as liner 88*a*. The liner 88*a* is similar to the liner 88 but differs there from by having its protruding ribs 98*a* (one shown) cast around a rigid strip 100 which is formed of the same material as the rigid structure 94*a*, and is suitably attached thereto such as by welding.

Figure 7:
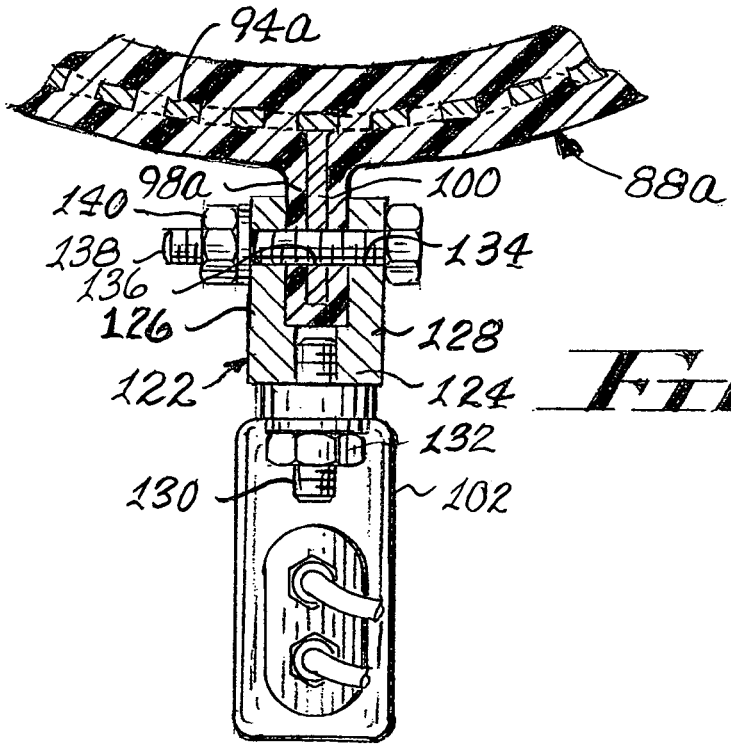
FIG. 7 is a sectional view similar to FIG. 6 and showing a second attachment means for mounting of the vibrating mechanism.

The cyclone 74 includes at least one vibrating device 102 which may be mounted on a selected one of the liners 88, 90 and 92 by any suitable means. One disclosed type of attachment means is seen best in FIG. 6 as being in the form of an especially configured C-clamp 104 that includes a clevis 106 having a cross member 108 from the opposite ends of which extend a spaced apart pair of parallel arms 110 and 112. A pair of studs 114 (one shown in FIG. 6) extend from the cross member 108 of the clevis 106 and the vibrator 102 is mounted on the studs and secured thereto by suitable nuts 116 (one shown). The clevis 106 straddles the rib 98 of the liner 88 and is clamped thereto by a screw 118 that is carried in the arm 112 of the clevis for threaded movement into clamping engagement with one side of the rib 98. The other arm 110 of the clevis 106 is formed with inwardly facing teeth 120 which penetrate the opposite side of the rib 98 to secure the vibrating device 102 and the C-clamp 104 against movements that could result from the generated vibrations. A second disclosed type of attachment means is shown in FIG. 7 to include a clevis 122 having a cross member 124 from the opposite ends of which extend a spaced apart pair of parallel arms 126 and 128. A pair of studs 130 (one shown) are carried in the cross member 124 of the clevis 122 and the vibrator 102 is mounted on the studs and secured thereto by suitable nuts 132 (one shown). The clevis 122 straddles the rib 98*a* of the liner 88*a* with arms 126 and 128 disposed adjacent opposite sides of the rib. A bore 134 is provided in each of the arms 126 and 128 so as to align with a bore 136 formed transversely through the rib 98*a* and a bolt 138 passes through the bores 134 and 136 and a nut 140 is carried on the bolt to secure the clevis 122 and vibrator 102 to the liner 88*a*.

It will be understood that the vibrators 36 and 102 may be electrically, hydraulically or pneumatically operated devices with one suitable vibrator being model No. CV-35 marketed under the trademark VIBROLATOR by the Martin Engineering Company, One Martin Place Neponset Ill. 61345-9766.

While the principles of the invention have now been made clear in illustrated embodiments, many modifications will be obvious to those skilled in the art which do not depart from those principles. The appended claims are therefore intended to cover such modifications within the limits only of the true spirit and scope of the invention.

What I claim is:

1. A cyclone for classifying materials comprising:

a) a head section for receiving the materials to be classified;

b) a conical housing of downwardly tapering configuration depending from said head section to receive the materials to be classified from said head section and classifying the received materials into relatively smaller and larger particles, said conical housing including, i. a flange defining the upper end of said conical housing, ii. a sleeve defining the lower end of said conical housing, iii. a plurality of strut means interconnecting said flange and said sleeve and spaced apart relative to each other to provide said conical housing with open sides;

c) at least one abrasion resistant liner means in said conical housing and having a peripheral surface which is exposed in the open sides of said conical housing; and d) at least one vibrating device means coupled to said abrasion resistant liner means for generating vibrations therein to augment the classification of the materials being processed.

2. A cyclone as claimed in claim 1 wherein said abrasion resistant liner means comprises:

a) a rigid structure; and b) abrasion resistant material encapsulating said rigid structure.

3. A cyclone as claimed in claim 1 wherein said abrasion resistant liner means comprises:

a) a rigid structure of truncated conical configuration;

b) abrasion resistant material encapsulating said rigid structure and having at least one longitudinally extending protruding rib; and c) said vibrating device being coupled to the protruding rib of said abrasion resistant material.

4. A cyclone as claimed in claim 1 wherein said abrasion resistant liner means comprises:

a) a metallic structure of truncated conical configuration with at least one longitudinally extending protruding rib;

b) abrasion resistant material encapsulating said metallic structure and the protruding rib thereof; and c) said vibrating device being coupled to the protruding rib of said metallic structure which is encapsulated by said abrasion resistant material.

5. A cyclone as claimed in claim 1 wherein said abrasion resistant liner means comprises:

a) a rigid structure of truncated conical configuration;

b) abrasion resistant material encapsulating said rigid structure and having at least one longitudinally extending protruding rib; and c) attachment means for coupling said vibrating device to the protruding rib of said abrasion resistant material.

6. A cyclone as claimed in claim 5 wherein said attachment means comprises;

a) a clevis having a cross member from the opposite ends of which extend a spaced apart pair of arms for straddling the rib of said abrasion resistant material;

b) a screw mounted transversely in one of the arms of said clevis for threaded movement into clamping engagement with the rib of said abrasion resistant material; and c) said vibrating device being mounted on the cross member of said clevis.

7. A cyclone as claimed in claim 1 wherein said abrasion resistant liner means comprises:

a) a metallic structure of truncated conical configuration;

b) at least one rib protruding from said metallic structure and extending longitudinally thereof;

c) abrasion resistant material encapsulating said metallic structure and said protruding rib; and d) attachment means for coupling said vibrating device to said encapsulated protruding rib.

8. A cyclone as claimed in claim 7 wherein said attachment means comprises:

a) said encapsulated protruding rib having a bore formed transversely there through;

b) a clevis having a cross member from the opposite ends of which extend a spaced apart pair of arms for straddling said encapsulated protruding rib; and c) a bolt and nut assembly carried transversely in the pair of arms of said clevis and passing through the bore formed through said encapsulated protruding rib for mounting said clevis thereon; and d) said vibrating device being mounted on the cross member of said clevis.

9. A cyclone as claimed in claim 1 wherein said abrasion resistant liner means comprises an upper, a middle and a lower liner each being of truncated conical configuration.

10. A cyclone as claimed in claim 9 wherein each of said upper, middle and lower liners comprise:

a) a rigid structure; and b) abrasion resistant material encapsulating said rigid structure.

11. A cyclone as claimed in claim 9 wherein each of said upper, middle and lower liners comprise:

a) a rigid structure;

b) abrasion resistant material encapsulating said rigid structure and having at least one longitudinally extending protruding rib; and c) said vibrating device being coupled to the protruding rib of said abrasion resistant material.

12. A cyclone as claimed in claim 9 wherein each of said upper, middle and lower liners comprises:

a) a metallic structure with at least one longitudinally extending protruding rib;

b) abrasion resistant material encapsulating said metallic structure and the protruding rib thereof; and c) said vibrating device being coupled to the protruding rib of said metallic structure which is encapsulated by said abrasion resistant material.

13. A cyclone as claimed in claim 9 wherein each of said upper, middle and lower liners comprise:

a) a rigid structure;

b) abrasion resistant material encapsulating said rigid structure and having at least one longitudinally extending protruding rib; and c) attachment means for coupling said vibrating device to the protruding rib of said abrasion resistant material.

14. A cyclone as claimed in claim 13 wherein said attachment means comprises:

a) a clevis having a cross member from the opposite ends of which extend a spaced apart pair of arms for straddling the protruding rib of said abrasion resistant material;

b) a screw mounted transversely in one of the arms of said clevis for threaded movement into clamping engagement with the rib of said abrasion resistant material; and c) said vibrating device being mounted on the cross member of said clevis.

15. A cyclone as claimed in claim 9 wherein each of said upper, middle and lower liners comprises:

a) a metallic structure;

b) at least one rib protruding from said metallic structure and extending longitudinally thereof;

c) abrasion resistant material encapsulating said metallic structure and said protruding rib; and d) attachment means for coupling said vibrating device to said encapsulated protruding rib.

16. A cyclone as claimed in claim 15 wherein said attachment means comprises:

a) said encapsulated protruding rib having a bore formed transversely there through;

b) a clevis having a cross member from the opposite ends of which extend a spaced apart pair of arms for straddling said encapsulated protruding rib; and c) a bolt and nut assembly carried transversely in the pair of arms of said clevis and passing through the bore formed through said encapsulated protruding rib for mounting said clevis thereon; and d) said vibrating device being mounted on the cross member of said clevis.

* * * * *